United States Patent [19]

Santhanam et al.

[11] Patent Number: 4,942,097

[45] Date of Patent: Jul. 17, 1990

[54] CERMET CUTTING TOOL

[75] Inventors: Anakkavur T. Santhanam, Monroeville; Edward V. Conley, Irwin, both of Pa.

[73] Assignee: Kennametal Inc., Latrobe, Pa.

[21] Appl. No.: 108,259

[22] Filed: Oct. 14, 1987

[51] Int. Cl.[5] ..... B22F 5/00

[52] U.S. Cl. ..... 428/552; 75/230; 75/241; 419/10; 419/15

[58] Field of Search ..... 419/10, 15; 428/552; 75/230, 241

[56] References Cited

U.S. PATENT DOCUMENTS

| | | | |
|---|---|---|---|
| 3,671,201 | 6/1972 | Bergna | 29/182.5 |
| 3,741,733 | 6/1973 | Kieffer | 29/182.5 |
| 3,971,656 | 7/1976 | Rudy | 75/203 |
| 3,994,692 | 11/1976 | Rudy | 75/205 X |
| 4,049,380 | 9/1977 | Yih et al. | 75/203 X |
| 4,049,876 | 9/1977 | Yamamoto et al. | 75/205 X |
| 4,120,719 | 10/1978 | Nomura et al. | 75/238 |
| 4,127,411 | 11/1978 | Yajima et al. | 75/204 X |
| 4,587,095 | 5/1986 | Yoshimura et al. | 419/15 X |
| 4,769,070 | 9/1988 | Tobioka et al. | 419/16 X |
| 4,778,521 | 10/1988 | Iyori et al. | 75/237 |

OTHER PUBLICATIONS

Doi, H., "Advanced TiC and TiC–TiN Base Cermets", Science of Hard Materials, (1986), pp. 489–523.

*Primary Examiner*—Peter A. Nelson
*Attorney, Agent, or Firm*—John J. Prizzi

[57] ABSTRACT

A cermet cutting tool is provided having a composition containing the following: about 3.5 to about 6.5 w/o (weight percent) nickel; about 4.5 to about 7.5 w/o cobalt, wherein the sum of nickel plus cobalt is between about 8 to 11 w/o; about 20 to about 25 w/o tungsten; about 5 to about 11 w/o molybdenum; up to about 6 w/o tantalum plus niobium; up to about 0.05 w/o chromium; up to about 1 w/o aluminum; and up to about 3 w/o vanadium; with the remainder being essentially titanium, carbon, and nitrogen, wherein at least substantially all the carbon and nitrogen are present as metal compounds selected from the group consisting of metal carbonitrides and mixtures of metal carbonitrides and metal carbides where said metal is selected from the group consisting of tungsten, molybdenum, titanium, tantalum, niobium, vanadium, chromium, their solid solutions and there mixtures.

24 Claims, 1 Drawing Sheet

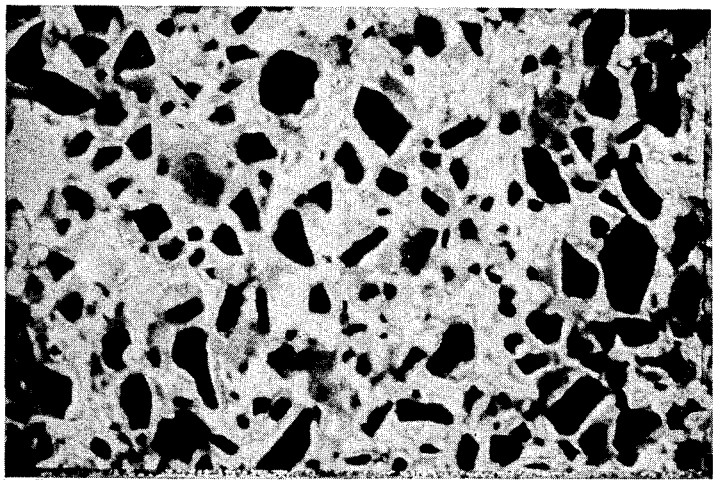

CERMET CUTTING TOOL

BACKGROUND OF THE INVENTION

The present invention relates to cermet compositions. It especially relates to cermet cutting tools for use in the cutting of metals and alloys.

As used herein, cermets shall mean sintered compositions containing a titanium carbonitride and a binder metal.

In the past, a variety of cermet cutting tools have been used to machine metals and alloys. These cermets have included those described in Rudy U.S. Pat. No. 3,971,656, which contain a carbonitride of titanium in solid solution with molybdenum or tungsten, and a binder metal or alloy, such as nickel and/or cobalt. Other cermet compositions containing titanium carbonitride are described in U.S. Pat. Nos.: 3,994,692; 3,741,733; 3,671,201; 4,120,719. Also of interest in this regard is H. Doi, "Advanced TiC and TiC-TiN Base Cermets," Science of Hard Materials (1986) pages 489–523. Commercial examples of such cermet cutting tool compositions (in weight percent, w/o) are shown in Table I.

TABLE I

COMMERCIAL CERMET CUTTING TOOL NOMINAL COMPOSITIONS

| | Grade | | | | |
|---|---|---|---|---|---|
| Element | A | B | C | D | E |
| Ti | 35.6 | 51.0 | 48 | 42.0 | 41.6 |
| W | 20.3 | 14.7 | 16.5 | 16.0 | 15.0 |
| Mo | 8.3 | 9.1 | 12.1 | 9.4 | 10.0 |
| Ni | 5.1 | 4.8 | 4.4 | 9.7 | 9.8 |
| Co | 8.2 | 4.9 | 4.9 | 1.9 | 1.7 |
| Total Ni + Co | 13.4 | 9.7 | 9.3 | 11.6 | 11.5 |
| Ta | 4.6 | 0.4 | — | 8.8 | 8.5 |
| Nb | 1.2 | 0.4 | — | — | — |
| V | 2.9 | 1.4 | — | — | — |
| C | 9.7 | 9.9 | — | 9.7 | 9.4 |
| N | 2.8 | 2.8 | — | 3.1 | 3.4 |
| O | 0.5 | — | — | — | — |

While the foregoing have performed well, there remains a need to produce a cermet composition cutting tool for turning applications having a toughness comparable to or better than prior art commercial cermet cutting tools, while having better wear resistance and significantly better performance (i.e., longer tool life) in metal cutting.

BRIEF SUMMARY OF THE INVENTION

The present inventors have surprisingly found that an improved cermet cutting tool for use in high speed, finish (i.e., low feed) turning operations is provided by combining a high tungsten content with a low binder metal content in the cermet composition containing the following: about 3.5 to about 6.5 w/o nickel; about 4.5 to about 7.5 w/o cobalt, wherein the sum of nickel plus cobalt is between about 8 to about 11 w/o; about 20 to about 25 w/o tungsten; about 5 to about 11 w/o molybdenum; up to about 6 w/o tantalum plus niobium; up to about 0.05 w/o chromium; up to about 1 w/o aluminum; up to about 3 w/o vanadium; with the remainder being essentially titanium, carbon and nitrogen except for impurities; wherein at least substantially all of the carbon and nitrogen are present as metal compounds selected from the group consisting of metal carbonitrides and mixtures of metal carbides and metal carbonitrides where the metal is selected from the group of tungsten, molybdenum, titanium, tantalum, niobium, vanadium, chromium, their solid solutions, and their mixtures.

In the composition according to the present invention, the total binder metal content (Ni+Co) should be at least 8.0 w/o to provide the necessary fracture toughness since reductions in binder content lead to lower fracture toughness. However, binder content should not exceed 11 w/o since wear resistance and tool life would decrease with increasing binder content. In view of the large amount of tungsten carbide in the present invention, both nickel and cobalt are added since nickel wets titanium carbide and titanium carbonitride better than cobalt, but cobalt wets tungsten carbide better than nickel. Preferably, nickel is held between about 3.5 and about 5.5 w/o and cobalt is held between about 4.5 and about 6.5 w/o. More preferably, nickel is limited to about 3.5 to about 4.5 w/o and cobalt is limited to about 4.5 to about 5.5 w/o.

Molybdenum is present at a level of at least about 5 w/o to improve the wettability of the nickel binder with the titanium carbonitride grains. Molybdenum preferably should not, however, exceed about 11 w/o. More preferably, the present composition contains about 9.5 to about 10.5 w/o molybdenum.

Tungsten is present in the composition at a level of above about 20 w/o to provide the composition with improved thermal conductivity and to provide an optimum combination of toughness and wear resistance. Tungsten, however, should not exceed about 25 w/o since above this amount the adverse affect of tungsten on the chemical wear resistance may be evident by the poorer crater wear resistance of the cutting tool during use. To provide greater assurance that the required crater wear resistance is present, tungsten is preferably held below about 23 w/o.

It should be noted that the improved cutting tool performances obtained in cutting tools composed of the present invention was surprisingly achieved without the use of the expensive alloying element tantalum. While this element is preferably not used herein due to its added expense, it is contemplated that it may be added alone to obtain further improvements in performance, or with one or more of: niobium, vanadium, chromium or aluminum.

Tantalum and/or niobium may be added in amounts not exceeding about 6 w/o (total Ta+Nb) for improved thermal shock and deformation resistance.

Vanadium may be present in amounts up to about 3 w/o, but preferably less than 2 w/o, to provide improved high temperature deformance resistance through the formation of solid solution titanium-vanadium carbides and carbonitrides.

Chromium at levels of up to 0.05 w/o may be added for improved high temperature creep resistance through the strengthening of the binder. Above 0.05 w/o, chromium has a tendency to reduce the ductility of the binder and, therefore, the toughness of the composition.

Aluminum may also be added to the present composition at levels up to about 1 w/o to provide improved binder strengthening through the formation of nickel aluminide precipitates in the binder.

The remainder of the material is titanium, carbon and nitrogen, except for impurities (e.g., oxygen). Where tantalum, niobium, vanadium or aluminum are not deliberately added, they may be present as impurities at levels of less than 0.05 w/o each.

The composition is made by conventional powder metallurgy techniques utilizing starting materials in which the titanium is added as titanium carbide and titanium carbonitride powders. The tungsten, molybdenum, vanadium, tantalum, niobium and chromium are preferably added as metal carbide powders. Tantalum may be alternatively added as tantalum nitride powder. Cobalt and nickel are added as metal powders. Aluminum, if added, may be added as an aluminum compound. These powders are preferably milled together, pressed and then sintered to provide an at least substantially fully dense shape which may be used as an indexable cutting insert with or without grinding and/or honing.

These and other aspects of the present invention will become more apparent upon review of the following detailed description of a preferred embodiment of the present invention in conjunction with the FIGURE briefly described below.

BRIEF DESCRIPTION OF THE DRAWINGS

The FIGURE shows a typical microstructure observed in a cutting insert in accordance with the present invention via SEM (scanning electron microscopy) at 5000× magnification.

DETAILED DESCRIPTION OF THE PREFERRED EMBODIMENT OF THE INVENTION

In accordance with the present invention, tungsten carbide, titanium carbonitride, titanium carbide, molybdenum carbide, cobalt and nickel powders were added together to form the first starting mix (Mix I) weighing 3000 grams as shown in Tables II and III.

TABLE II

| | STARTING INGREDIENTS | | | | | | | | | |
|---|---|---|---|---|---|---|---|---|---|---|
| | Apparent Particle | | w/o in Starting Ingredients | | | | | | | |
| Ingredient | Size (Microns)* | Spec. Gravity | Total Carbon | $O_2$ | Co | Ni | Ti | $N_2$ | Mo | W |
| Tungsten Carbide | 1.36 | 15.6 | 6.07 | | | | | | | 93.9 |
| Titanium Carbonitride (premilled) | 1.65 | 5.0 | 13.93 | | | | 79.0 | 6.63 | | |
| Titanium Carbide (premilled) | 1.02 | 4.95 | 19.70 | | | | 80.0 | | | |
| Molybdenum Carbide (premilled) | 1.00 | 9.0 | 6.18 | | | | | | 92.75 | |
| Cobalt (Afrimet X-Fine) | 1.46 | 8.9 | — | 0.64 | 99.36 | | | | | |
| Nickel (Inco 255) | 2.55 | 8.9 | — | 0.17 | | 99.83 | | | | |

*by Fisher subsieve analysis

TABLE III

| | PROPORTIONS IN MIX | | | | | | | | |
|---|---|---|---|---|---|---|---|---|---|
| | w/o in | w/o in Mix | | | | | | | Weight |
| Ingredient | Mix | TC | Ni | Co | Mo | Ti | $N_2$ | W | (grams) |
| Tungsten Carbide | 21.85 | 1.33 | | | | | | 20.52 | 655.5 |
| Titanium Carbonitride | 46.45 | 6.47 | | | | 36.70 | 3.08 | | 1393.5 |
| Titanium Carbide | 11.75 | 2.31 | | | | 9.40 | | | 352.5 |
| Molybdenum Carbide | 10.95 | 0.68 | | | 10.16 | | | | 328.5 |
| Cobalt | 5.15 | −0.02 | | 5.12 | | | | | 154.5 |
| Nickel | 3.85 | 0.0 | 3.84 | | | | | | 115.5 |
| Total in Mix | 100.00 | 10.77 | 3.84 | 5.12 | 10.16 | 46.10 | 3.08 | 20.52 | 3000.0 |

The starting mix was milled with 21,000 grams of cemented tungsten carbide cycloids in a mill jar with heptane for 36 hours to produce an apparent particle size of about 0.7 to 0.8 microns. The mill slurry was then discharged into a sigma blade dryer with a lubricant and a surfactant. After drying, the mixture was Fitzmilled through a screen. The mix was then cold pill pressed and vacuum sintered. Sintering was carried out with a hold at 1200° C. for 30 minutes during heating up to 1450° C. where it was held for 90 minutes after which the power was turned off and the furnace allowed to cool.

The foregoing processing resulted in a sintered product having the typical microstructure shown in the FIGURE. As shown in the FIGURE, the carbide and carbonitride grains are very fine (<1–3 microns) and exhibit a bimodal size distribution.

The large black grains shown in the FIGURE are believed to be a titanium carbonitride phase which may contain molybdenum and/or tungsten in solid solution. The light grey phase surrounding the large black grains is also believed to be a titanium carbonitride phase, however, with higher levels of molybdenum and/or tungsten than in the black phase. The white grains are believed to be tungsten rich carbide grains which may also contain in solid solution molybdenum and titanium. Because of the nature of scanning electron microscopy, the binder phase, containing nickel, cobalt and molybdenum and which also may contain minor amounts of tungsten, carbon, titanium and nitrogen, does not show up very well in the FIGURE.

The foregoing process produces at least a substantially fully dense product exhibiting type A porosity; typically, only A02 to A04 type porosity. Type B porosity, while not preferred, may be present without adverse impact on cutting performance.

A second mix, (Mix II) in accordance with the present invention was made by milling, pressing and sintering in a manner similar to the Mix I procedure with the most notable exception being that argon sintering, rather than vacuum sintering, was utilized. Mix II has a higher tungsten content than Mix I.

A third mix, (Mix III) outside of the present invention due to low tungsten content, was made for comparison purposes. The as sintered chemistries (in w/o) as well as other properties of Mixes I, II and III are shown in Table IV. It should be noted that after sintering Mix I contained about 23 w/o tungsten, an increase of about 2.5 w/o over the tungsten level in the mix prior to milling (see Table III). This increase in tungsten content is believed to be due to pickup of tungsten carbide from the cemented tungsten carbide cycloids used in milling the powder mix.

TABLE IV

| SINTERED CHEMISTRY | | | |
|---|---|---|---|
| Mix No. | I | II | III |
| Element | | | |
| Ti | 43. | 42.9 | 46 |
| W | 23.0 | 24.9 | 19.7 |
| Mo | 10.0 | 9.0 | 10.2 |
| Ni | 4.5 | 3.8 | 4.3 |
| Co | 5.2 | 5.1 | 5.6 |
| Total Ni + Co | 9.7 | 8.9 | 9.9 |
| Ta | — | — | — |
| Nb | — | — | — |
| Cr | — | — | — |
| V | — | — | — |
| C | 10.6 | 10.2 | 11.0 |
| N | 2.6 | 2.8 | 2.7 |
| O | 0.7 | 0.5 | — |
| Properties | | | |
| Density (g/cc) | 6.7 | 6.7 | 6.68 |
| Hardness (Rockwell A) | 93.2 | 93.3 | 93.2 |
| Magnetic Saturation (Ms) | 7.6 | 9.8 | 9.0 |
| Coercive Force (Hc) | 174 | 205 | 195 |
| Porosity | AO2 | AO6/AO8 BOO-4 | AO2 |

The sintered product from the foregoing three mixes was then ground to style SNG-433 indexable cutting inserts and tested against style SNG-433 inserts composed of commercial grades B, C, D and E in the metal cutting tests whose procedures and results are delineated in Tables V through IX (tool life is reported in minutes).

In the tests described in Table V, it can be clearly seen that, under the high speed, low feed (i.e., finishing conditions) turning test conditions utilized that Mix II in accordance with the present invention was clearly superior to the commercial grades tested. However, at the high speed and high feed conditions (roughing) used in the test described in Table VI, the performance of Mix II was roughly equivalent to commercial grades C and B.

TABLE V

| TURNING AISI 1045 STEEL (180–200 BHN) | | | | |
|---|---|---|---|---|
| Tool Material | Tool Life & Tool Failure Mode | | | Avg. |
| Commercial Grade D | 20.0 fw | 11.8 fw | 13.0 fw | 14.9 |
| Commercial Grade E | 14.2 mw | 10.5 fw | 8.7 fw | 11.1 |
| Mix II | 34.0 fw | 39.8 fw | 32.9 fw–ch | 35.6 |
| Commercial Grade C | 11.9 fw | 12.2 fw | 19.7 fw | 14.6 |
| Commercial Grade B | 28.1 fw | 19.2 fw | 14.9 fw | 20.7 |

Test Conditions:

1000 sfm (surface feet/minute)/.010 ipr (inch/revolution)/.100 inch doc (depth of cut)
SNG-433 (.003–.004 inch × 25° k-land)
15° lead angle
no coolant.
Tool Life Criteria (used for all tests reported in Tables V–IX):

| | |
|---|---|
| fw | .015" uniform flank wear |
| mw | .030" concentrated flank wear |
| cr | .004" crater wear |
| dn | .030" depth of cut notch |
| ch | .030" concentrated wear or chip |
| bk | breakage |

TABLE VI

| TURNING AISI 1045 STEEL (180–200 BHN) | |
|---|---|
| Tool Material | Tool Life & Tool Failure Mode |
| Commercial Grade D | 2.4 bk |
| Commercial Grade E | 2.1 bk |
| Mix II | 3.5 cr |
| Commercial Grade C | 3.6 fw |
| Commercial Grade B | 3.3 cr |

Test Conditions:

1000 sfm/.026 ipr/.100 inch doc
remainder of test conditions same as in Table V

In the test described in Table VII, Mix II outperformed both comparison Mix III and commercial grade B by a margin of at least about 2 to 1.

In the test described in Table VIII, Mix II outperformed commercial grade B by somewhat less than 2 to 1 and comparison Mix III by somewhat less than 3 to 1. In the one trial where Mix II failed, after only 8.1 minutes, subsequent examination of the insert revealed it to have a slightly larger K-land than the other inserts which may have accounted for the early failure.

From the foregoing tests, it is clear that Mix II offers better wear resistance compared to the grades it was tested against under finishing-type turning conditions.

TABLE VII

| TURNING AISI 1045 STEEL (180–200 BHN) | | | | |
|---|---|---|---|---|
| Tool Material | Tool Life & Tool Failure Mode | | | Avg. |
| Mix III | 11.5 dn | 15.8 fw | 17.9 mw | 15.1 |
| Mix II | 34.9 fw | 44.2 bk | 44.8 fw | 41.3 |
| Commercial Grade B | 14.4 fw | 24.8 fw | 14.8 fw | 18.0 |

Test Conditions:

Same as Table V

TABLE VIII

| TURNING AISI 4340 STEEL (280–300 BHN) | | | | |
|---|---|---|---|---|
| Tool Material | Tool Life & Tool Failure Mode | | | Avg. |
| Mix III | 3.7 fw | 5.5 mw | 7.4 mw | 5.5 |
| Mix II | 8.1 fw | 18.4 fw | 22.0 fw | 16.2 |
| Commercial Grade B | 9.0 fw | 8.5 fw | 9.9 fw | 9.1 |

Test Conditions:

800 sfm/.010 ipr/.100 inch doc
remainder of test conditions same as in Table V

In the tests described in Table IX, the effect of cutting edge preparation (honed vs. chamfered, i.e.: K-landed) was studied and the performance of honed cutting inserts in accordance with the present invention was compared to honed commercial inserts. As can be seen in Table IX, the honed Mix I inserts performed substantially better than K-landed Mix I inserts. It was further observed that the Mix I inserts in the honed condition were not more prone to chipping and breakage than the Mix I inserts in the K-landed condition.

TABLE IX

| TURNING AISI 1045 STEEL (187-207 BHN) | | | | | |
|---|---|---|---|---|---|
| Tool Material | Edge Preparation | Tool Life & Tool Failure Mode | | | Avg. |
| Mix I | hone | 22.8 fw | 24.6 cr | 19.9 fw | 22.4 |
| Mix I | K-land | 13.2 cr | 14.7 fw | | 14.0 |
| Commercial Grade B | hone | 9.9 fw | 14.9 fw | 14.3 fw | 13.0 |
| Mix II | hone | 18.2 fw | 19.8 bk | 15.0 ch | 17.7 |
| Commercial Grade C | hone | 18.0 fw | 18.0 dn | 12.8 dn | 16.3 |

Test Conditions:

1200 sfm/.010 ipr/.100 inch doc
SNG-433 (.001-.002 inch radius hone)
SNG-433 (.003-.004 inch × 25° K-land)
15° lead angle
no coolant.

Honed Mix I inserts also performed substantially better than honed commercial grades B and C and honed Mix II. The honed Mix II inserts performed roughly equal to commercial grade C and only slightly better than commercial grade B.

Direct comparisons between the present invention as exemplified by Mixes I and II, and commercial grade A, were not possible due to differences in the available geometry of the grade A cutting inserts. Attempts to compare the present invention against grade A were, however, made using similar (not identical) geometry inserts. In these tests, while the grade A inserts had longer lifetimes than the inserts in accordance with the present invention, these results were inconclusive since it was uncertain whether observed differences in performance was due to differences in insert geometry, chemistry or a combination of both. It should be noted that commercial grade A contains significant quantities of tantalum, niobium and vanadium additions in conjunction with a high tungsten content. While the present invention allows such additions to be made, Mixes I and II did not contain such additions.

All patents and documents referred to herein are hereby incorporated by reference.

Other embodiments of the invention will be apparent to those skilled in the art from a consideration of this specification or practice of the invention disclosed herein. It is intended that the specification and examples be considered as exemplary only, with the true scope and spirit of the invention being indicated by the following claims.

What is claimed is:

1. A cermet cutting tool consisting essentially of:
about 3.5 to about 6.5 w/o nickel;
about 4.5 to about 7.5 w/o cobalt; wherein the sum of nickel+cobalt is between about 8.0 to about 11.0 w/o;
about 20 to about 25 w/o tungsten;
about 5 to about 11.0 w/o molybdenum;
up to about 6 w/o tantalum plus niobium;
up to about 0.05 w/o chromium;
up to about 1 w/o aluminum;
up to about 3 w/o vanadium;
and the remainder being essentially titanium, carbon, and nitrogen, wherein at least substantially all carbon and nitrogen are present as metal compounds selected from the group consisting of metal carbonitrides and mixtures of metal carbides and metal carbonitrides where said metal is selected from the group consisting of tungsten, molybdenum, titanium, tantalum, niobium, vanadium, chromium, and their solid solutions and their mixtures.

2. The cermet cutting tool according to claim 1 wherein nickel is limited to between 3.5-5.5 w/o.

3. The cermet cutting tool according to claim 1 wherein cobalt is limited to between 4.5-6.5 w/o.

4. The cermet cutting tool according to claim 1 wherein nickel is limited to 3.5 to 4.5 w/o.

5. The sintered cermet cutting tool according to claim 3 wherein nickel is limited to between 3.5 to 4.5 w/o.

6. The sintered cermet cutting tool according to claim 1 wherein cobalt is limited to 4.5 to 5.5 w/o.

7. The sintered cermet cutting tool according to claim 4 wherein cobalt is limited to 4.5 to 5.5 w/o.

8. The sintered cermet cutting tool according to claim 1 wherein molybdenum is limited to about 9.5 to about 10.5 w/o.

9. The sintered cermet cutting tool according to claim 4 wherein molybdenum is limited to about 10 to about 10.4 w/o.

10. The sintered cermet cutting tool according to claim 1 wherein vanadium is an impurity present at no more than 0.05 w/o.

11. The sintered cermet cutting tool according to claim 4 wherein vanadium is an impurity present at no more than 0.05 w/o.

12. The sintered cermet cutting tool according to claim 8 wherein vanadium is an impurity present at no more than 0.05 w/o.

13. The sintered cermet cutting tool according to claim 9 wherein vanadium is an impurity present at no more than 0.05 w/o.

14. The cermet cutting tool according to claim 1 wherein tantalum is an impurity present at no more than 0.05 w/o and wherein niobium is an impurity present at no more than 0.05 w/o.

15. The cermet cutting tool according to claim 7 wherein tantalum is an impurity present at no more than 0.05 w/o and wherein niobium is an impurity present at no more than 0.05 w/o.

16. The cermet cutting tool according to claim 8 wherein tantalum is an impurity present at no more than 0.05 w/o and wherein niobium is an impurity present at no more than 0.05 w/o.

17. The cermet cutting tool according to claim 9 wherein tantalum is an impurity present at no more than 0.05 w/o and wherein niobium is an impurity present at no more than 0.05 w/o.

18. The cermet cutting tool according to claim 10 wherein tantalum is an impurity present at no more than 0.05 w/o and wherein niobium is an impurity present at no more than 0.05 w/o.

19. The cermet cutting tool according to claim 13 wherein tantalum is an impurity present at no more than 0.05 w/o and wherein niobium is an impurity present at no more than 0.05 w/o.

20. The cermet cutting tool according to claim 1 wherein tungsten is limited to about 20 to 23 w/o.

21. The cermet cutting tool according to claim 7 wherein tungsten is limited to about 20 to 23 w/o.

22. The cermet cutting tool according to claim 8 wherein tungsten is limited to about 20 to 23 w/o.

23. The cermet cutting tool according to claim 9 wherein tungsten is limited to about 20 to 23 w/o.

24. A cermet cutting tool consisting essentially of:
about 3.5 to about 4.5 w/o nickel;
about 4.5 to about 5.5 w/o cobalt;

about 20 to about 25 w/o tungsten;
about 9.5 to about 10.5 w/o molybdenum;
and the remainder being essentially titanium, carbon and nitrogen, except for impurities; wherein at least substantially all said carbon and nitrogen are present as metal compounds selected from the group consisting of the carbides and carbonitrides of titanium, tungsten, molybdenum, their solid solutions and their mixtures.

* * * * *